US005471537A

United States Patent [19]

Castwall

[11] Patent Number: 5,471,537

[45] Date of Patent: Nov. 28, 1995

[54] KITCHEN VENTILATOR

[75] Inventor: Lennart W. Castwall, Täby, Sweden

[73] Assignee: Aktiebolaget Electrolux, Stockholm, Sweden

[21] Appl. No.: 145,350

[22] Filed: Oct. 29, 1993

[30] Foreign Application Priority Data

Nov. 3, 1992 [SE] Sweden ..... 92032481

[51] Int. Cl.[6] ..... G10K 11/16

[52] U.S. Cl. ..... 381/71; 181/224

[58] Field of Search ..... 181/225, 224; 381/71

[56] References Cited

U.S. PATENT DOCUMENTS

| | | | |
|---|---|---|---|
| 4,044,203 | 8/1977 | Swinbanks | 381/71 |
| 4,118,226 | 10/1978 | Bourassa | 55/279 |
| 4,279,325 | 7/1981 | Challis | 181/225 |
| 4,432,434 | 2/1984 | Dean, Jr. | 181/225 |
| 4,733,750 | 3/1988 | Poirier et al. | 181/225 |
| 4,965,832 | 10/1990 | Edwards et al. | 381/71 |
| 5,299,634 | 4/1994 | Toyoda et al. | 181/225 |

FOREIGN PATENT DOCUMENTS

| | | | |
|---|---|---|---|
| 161784B | 8/1991 | Denmark . | |
| 0008387 | 7/1979 | European Pat. Off. . | |
| 2438796 | 10/1978 | France . | |
| 2161217 | 1/1986 | United Kingdom | 181/225 |

*Primary Examiner*—Forester W. Isen
*Attorney, Agent, or Firm*—Pearne, Gordon, McCoy & Granger

[57] ABSTRACT

A kitchen ventilator includes a housing (10) having a motor powered fan (20), an inlet (11), an inlet passage (25) between the inlet and the fan, an outlet (17), and an outlet passage (23) between the fan and the outlet, the passages are separated by a generally vertical partition wall (22). The inlet passage is partially formed by a baffle wall (26) provided between the inlet and the fan, and a removable front wall (16) provided with a sound absorbing material, and the outlet passage (23) has a narrowing portion (33) which is provided on both sides with sound absorbing material (18, 19).

For reducing the noise level, the ventilator is provided with an acoustic sensor (28) for sensing the noise of the fan, a loudspeaker (30) for emitting a sound silencing the fan noise in reverse phase therewith, and an electronic control unit (29) connected to the sensor and the loudspeaker and adapted to control the loudspeaker in response to information received from said sensor.

6 Claims, 2 Drawing Sheets

KITCHEN VENTILATOR

BACKGROUND OF THE INVENTION

The present invention relates to a kitchen ventilator having a housing, a motor powered fan having a horizontal axis arranged in the bottom portion of the housing, an inlet, an inlet passage between the inlet and the fan, an outlet, and an outlet passage between the fan and the outlet, the passages being separated by a generally vertical partition wall.

In order to efficiently collect fumes produced in connection with cooking a relatively heavy air flow is required and in order to obtain this a large capacity fan is necessary. The drawback of such a fan is that it produces a relatively heavy, disturbing noise.

SUMMARY OF THE INVENTION

The object of the invention is to reduce this noise problem by providing a ventilator in which the noice level has been minimized. This has been obtained by means of a ventilator in which the inlet passage is formed partially by a baffle wall provided between the inlet and the fan, and a removable front wall provided with a sound absorbing material, the outlet passage having a narrowing portion which is provided on both sides with sound absorbing material.

BRIEF DESCRIPTION OF THE DRAWINGS

The invention will be described in more detail below with reference to the accompanying drawings, in which.

DETAILED DESCRIPTION OF THE PREFERRED EMBODIMENT

Figure 1:
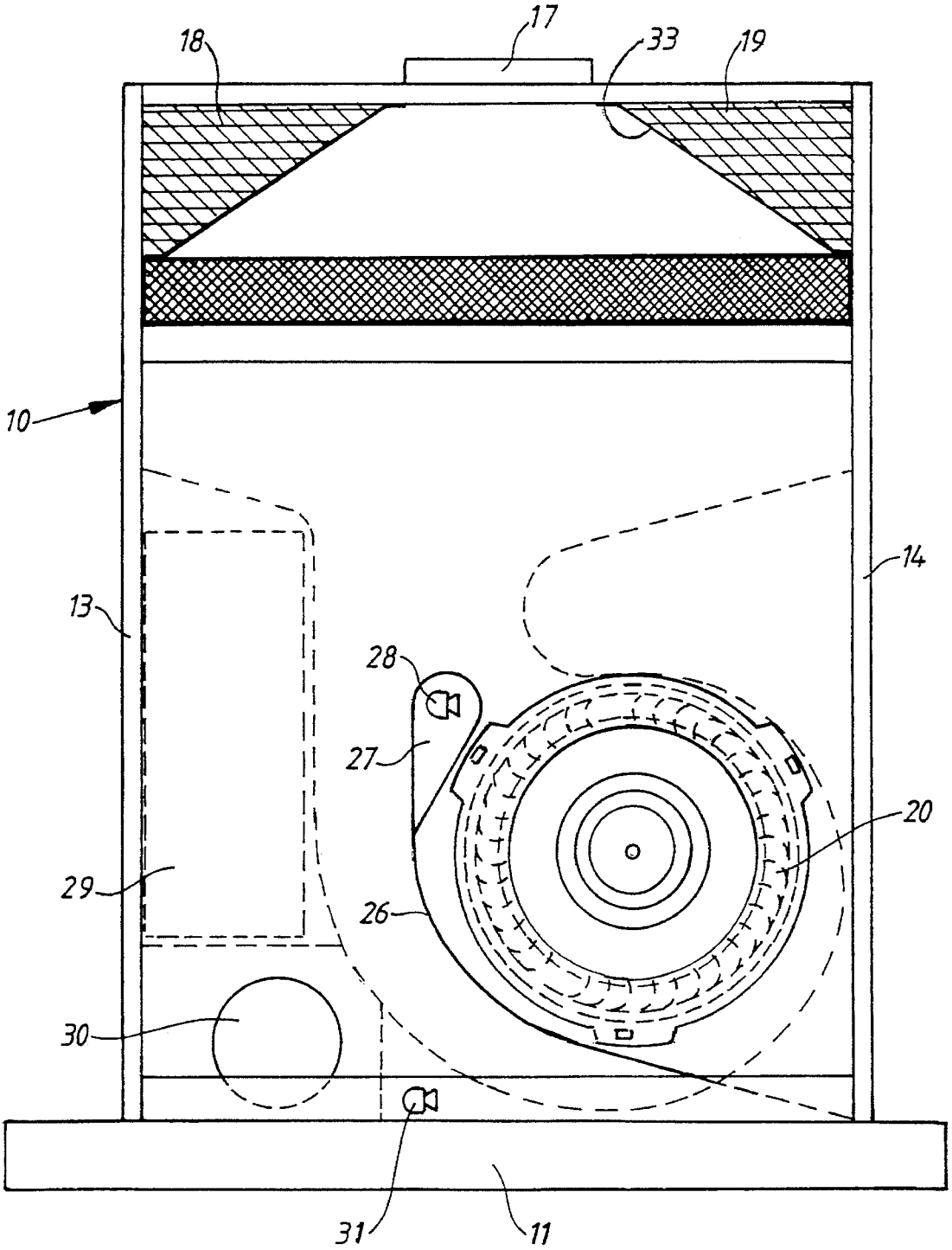
FIG. 1 illustrates a front view of the ventilator according to the invention with the front wall thereof removed.
Figure 2:
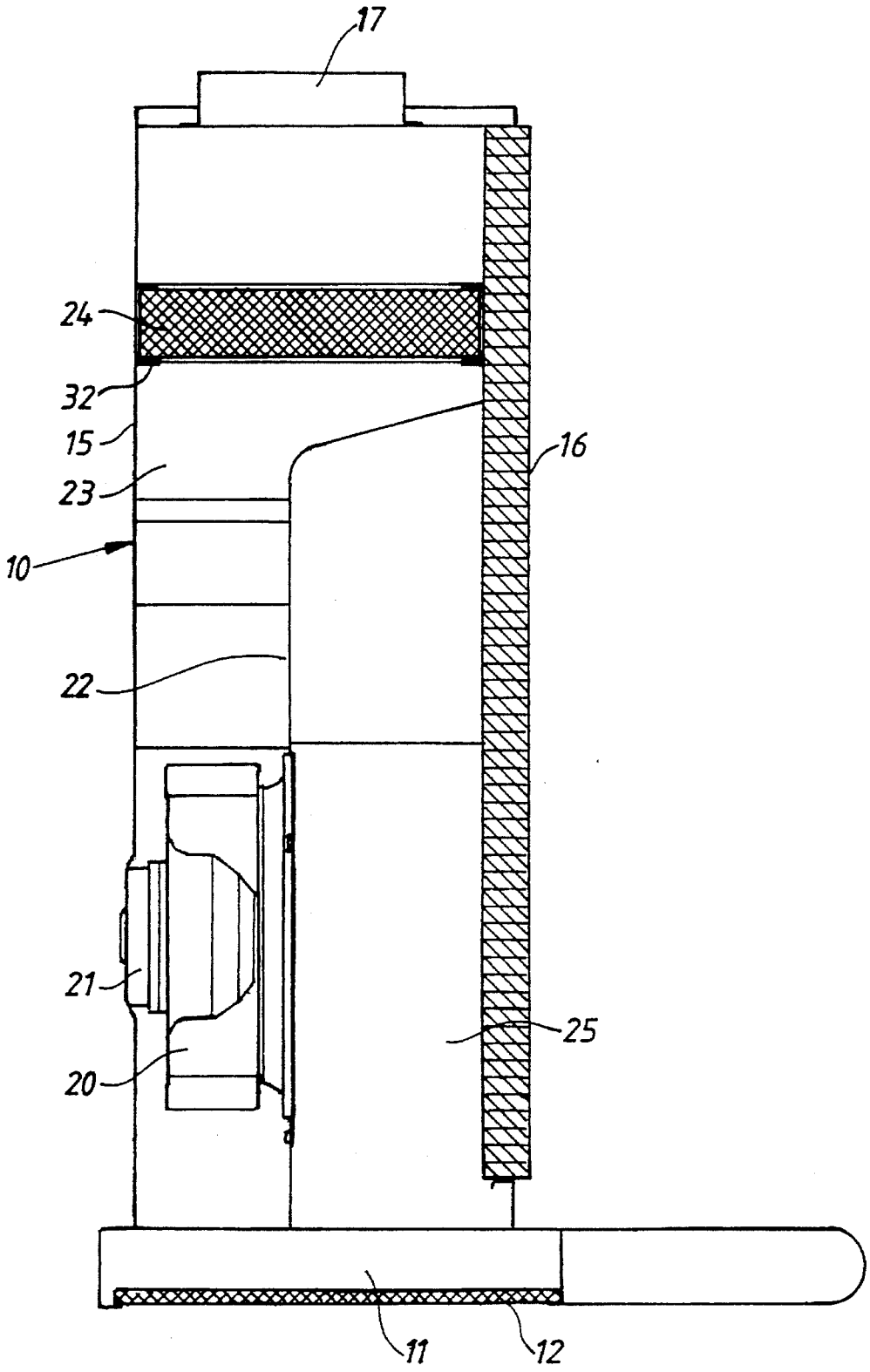
FIG. 2 is a vertical section of the ventilator.

The ventilator shown in the drawings comprises a housing 10 which at its lower end has an inlet 11 provided with a so-called grease filter 12. The housing has vertical side walls 13, 14, a rear wall 15, and a removable front wall 16 which on its inside is provided with a sound absorbing material. The housing has an outlet 17 provided centrally at the upper end thereof.

A fan 20 having a horizontal axis and powered by an electric motor 21 is provided at the lower portion of the housing. The interior of the housing is divided by means of a vertical partition wall 22 into an inlet passage 25 disposed in front of the partition wall and connected to the inlet 11 of the housing, and an outlet passage 23 disposed behind the wall and connected to the outlet 17. The fan 20 is provided behind the wall 22 and has an inlet connected to a corresponding opening therein. The outlet passage 23 is provided at its upper portion with a bracket 32 for an odor filter 24 which is removable and can be used optionally. The odor filter 24 preferably contains active carbon and is primarily intended to be used when the air discharged via the outlet 17 is recirculated, and can be disposed with when the outlet is connected to an evacuation passage. Between the air filter 24 and the outlet 17 the outlet passage 23 has a narrowing portion 33 which on both sides has chambers 18, 19 provided with sound absorbing material.

The space in the housing 10 in front of the partition wall 22 forms an inlet passage 25 extending from the inlet 11 to the fan 20. In this space a baffle wall 26 extends from one side of the inlet 11 and partially around the fan to the same level as the top portion thereof. The object of the baffle wall is to screen off the fan noise from the inlet 11 of the housing. The upper end of the baffle wall is rounded and surrounds a chamber 27. Air entering the inlet 11 flows upwards through the housing on the left side of the baffle wall 26 and around the upper end thereof to the fan 20. The inlet passage 25 has a relatively large area which results in a low flow velocity and consequently a low noise level.

In order to reduce low frequency noise the ventilator is provided with means for active silencing of noise comprising a first acoustic sensor 28 provided in the chamber 27 and sensing the fan noise in the vicinity of the fan inlet. The signal from the sensor 28 is processed in an electronic control unit 29 controlling a loudspeaker 30 provided adjacent the inlet 11 of the housing. The loudspeaker emits a sound which is phase shifted in such way as to be in reverse phase relative to the sound sensed by the sensor 28 which is thereby actively silenced. A second acoustic sensor 31 is provided in the inlet passage 25 adjacent the inlet 11 and is equally connected to the control unit 29. By means of this second sensor it is monitored that the sound emitted by the loudspeaker 30 has the correct character and phase shift in order that the sound silencing operates in the intended manner. If this should not be the case, the control unit performs a required correction in response to the signal received from the sensor 31, until the desired result is obtained. Low frequency noise from the fan 20 can thereby be eliminated to a large extent.

By means of the ventilator described above it has appeared to be possible to obtain an essentially reduced noise level without reducing the capacity.

It is a further essential advantage of the ventilator according to the invention that it is easily available for cleaning which is important from the viewpoint of fire-protection. By removal of the front wall 16 the inlet passage 25 and the fan 20 are made easily available. The impeller of the fan is easily removable from the motor 21 whereby the lower portion of the outlet passage 23 becomes available through the opening in the wall 22. The top portion of the outlet passage can be made easily available by removal of the odor filter 24.

I claim:

1. Kitchen ventilator comprising a housing (10), a motor powered fan (20) having a horizontal axis arranged in a bottom portion of the housing, an inlet (11), an inlet passage (25) extending between the inlet and the fan, an outlet (17), an outlet passage (23) extending between the fan and the outlet, and a removable front wall (16) including sound absorbing material, said passages being separated by a generally vertical partition wall (22) which defines an opening through which air from the inlet passage is drawn by said fan into said outlet passage, wherein the inlet passage is defined in part by a baffle wall (26) provided between the inlet (11) and the fan (20), said baffle wall (26) forcing air entering said inlet to flow in an indirect path toward said fan and helping to reduce the transmission of noise from said fan to said inlet, said outlet passage (23) having a narrowing portion (33) which is bounded on opposite sides by sound absorbing material (18, 19).

2. Kitchen ventilator according to claim 1, wherein the outlet passage (23) includes a bracket (32) for mounting of a removable odor filter (24).

3. Kitchen ventilator according to claim 1 or 2, further comprising means for silencing noise produced by said fan, said silencing means comprising a first acoustic sensor (28) for sensing noise produced by the fan, a loudspeaker (30) for emitting a sound silencing the fan noise and in reverse phase therewith, and an electronic control unit (29) connected to said first sensor and said loudspeaker and adapted to control the loudspeaker in response to information received from said first sensor.

4. Kitchen ventilator according to claim 3, wherein said first acoustic sensor (28) senses the fan noise in the vicinity of the fan (20), and a second acoustic sensor (31) senses the fan noise at the inlet (11), said first and second acoustic sensors being connected to the control unit (29) whereby the sound emitted by the loudspeaker is corrected in response to information received from said second sensor.

5. Kitchen ventilator according to claim 1, wherein the baffle wall extends between said front wall and said partition wall.

6. Kitchen ventilator according to claim 1 or 5, wherein the fan is located in the outlet passage adjacent the opening in the partition wall.

* * * * *

UNITED STATES PATENT AND TRADEMARK OFFICE

CERTIFICATE OF CORRECTION

PATENT NO. : 5,471,537

DATED : November 28, 1995

INVENTOR(S) : Lennart W. Castwall

It is certified that error appears in the above-identified patent and that said Letters Patent is hereby corrected as shown below:

Abstract, line 4, ", the" should be --. The--.

Column 2, line 62, "1 or 2," should be --1, 2 or 5,--.

Signed and Sealed this

Fourteenth Day of May, 1996

Bruce Lehman

*Attest:*

BRUCE LEHMAN

*Attesting Officer*

*Commissioner of Patents and Trademarks*